US006559576B1

(12) United States Patent
Ikedo et al.

(10) Patent No.: US 6,559,576 B1
(45) Date of Patent: May 6, 2003

(54) GAS DISCHARGE TUBE HAVING SEALED ENVELOPE WITH METALLIC PORTION AND LIGHT PROJECTION GLASS WINDOW

(75) Inventors: Tomoyuki Ikedo, Shizuoka-ken (JP); Kouzou Adachi, Shizuoka-ken (JP); Yoshinobu Ito, Shizuoka-ken (JP); Ryotaro Matui, Shizuoka-ken (JP)

(73) Assignee: Hamamatsu Photonics K.K., Shizuoka-ken (JP)

( * ) Notice: Subject to any disclaimer, the term of this patent is extended or adjusted under 35 U.S.C. 154(b) by 296 days.

(21) Appl. No.: 09/598,992

(22) Filed: Jun. 22, 2000

Related U.S. Application Data

(63) Continuation-in-part of application No. PCT/JP98/05822, filed on Dec. 22, 1998.

(30) Foreign Application Priority Data

| | | |
|---|---|---|
| Dec. 24, 1997 | (JP) | 9-355352 |
| Sep. 7, 1998 | (JP) | 10-252589 |
| Sep. 7, 1998 | (JP) | 10-252590 |
| Sep. 7, 1998 | (JP) | 10-252603 |

(51) Int. Cl.[7] ..... H01J 5/20; H01J 5/18; H01J 5/04

(52) U.S. Cl. ..... 313/25; 313/623; 313/600

(58) Field of Search ..... 313/25, 623, 626, 313/634, 635, 636, 283, 284, 600, 281

(56) References Cited

U.S. PATENT DOCUMENTS

| | | | | | |
|---|---|---|---|---|---|
| 3,956,655 | A | * | 5/1976 | Pevo | 313/112 |
| 4,020,379 | A | * | 4/1977 | Manning | 313/281 |
| 5,057,742 | A | * | 10/1991 | Kawai et al. | 313/242 |
| 5,552,669 | A | | 9/1996 | Ikedo et al. | 313/613 |
| 5,619,101 | A | | 4/1997 | Ikedo et al. | 313/581 |
| 5,633,563 | A | | 5/1997 | Ikedo et al. | 313/614 |
| 5,959,301 | A | * | 9/1999 | Warashina | 250/372 |
| 6,339,279 | B1 | * | 1/2002 | Miyamoto et al. | 313/113 |
| 6,339,280 | B1 | * | 1/2002 | Miyamoto et al. | 313/113 |
| 6,380,663 | B1 | * | 4/2002 | Ikedo et al. | 313/25 |

FOREIGN PATENT DOCUMENTS

| | | |
|---|---|---|
| JP | 4-341750 | 11/1992 |
| JP | 6-60852 | 3/1994 |
| JP | 8-64179 | 3/1996 |
| JP | 8-77965 | 3/1996 |
| JP | 8-77969 | 3/1996 |
| JP | 8-222186 | 8/1996 |
| JP | 8-236081 | 9/1996 |
| JP | 10-302729 | 11/1998 |
| JP | 10-302730 | 11/1998 |
| JP | 10-302731 | 11/1998 |

* cited by examiner

*Primary Examiner*—Nimeshkumar D. Patel
*Assistant Examiner*—Karabi Guharay
(74) *Attorney, Agent, or Firm*—Morgan, Lewis & Bockius LLP

(57) ABSTRACT

In a gas discharge tube in accordance with the present invention, a side tube is formed from a metal, the outer periphery of the stem is provided with a joint portion made of a metal, and the latter is joined to a metal-made joint portion of the side tube by welding, whereby the assembling is made easier by welding, while the gas discharge tube itself can attain smaller dimensions. Also, since the side tube is small and made of a metal, its handling improves greatly. Further, since side tube is formed from a metal, the gas discharge tube is encouraged to have a wider range of processed forms and attains a prospect for mass production.

5 Claims, 5 Drawing Sheets

GAS DISCHARGE TUBE HAVING SEALED ENVELOPE WITH METALLIC PORTION AND LIGHT PROJECTION GLASS WINDOW

RELATED APPLICATION

This is a continuation-in-part application of application serial no. PCT/JP98/05822 filed on Dec. 22, 1998, now pending.

BACKGROUND OF THE INVENTION

1. Field of the Invention

The present invention relates to a gas discharge tube; and, in particular, to a gas discharge tube for use as a light source for a spectroscope, chromatography, or the like.

2. Related Background Art

As techniques in such a field, those disclosed in Japanese Patent Application Laid-Open Nos. HEI 7-326324 and HEI 8-222185 have conventionally been known. In the deuterium lamps described in these publications, a sealed envelope is constituted by a side tube made of glass and a stem made of glass, stem pins are secured to the stem, anode and cathode sections are secured to the respective stempins, and the sealed envelope is filled with about several Torr of deuterium gas. Such a deuterium lamp is utilized as a stable UV light source.

SUMMARY OF THE INVENTION

Since the conventional deuterium lamps are configured as mentioned above, however, there have been problems as follows.

Namely, since the above-mentioned sealed envelope is made of glass as a whole from the viewpoint of freedom in processing, the temperature at the junction between the side tube made of glass and the stem made of glass exceeds 1000° C. when they are thermally fused to each other. As its countermeasures, it is necessary to employ a floating structure in which the anode and cathode sections are separated from the junction, whereby the sealed envelope increases its dimensions, which inevitably enlarges the deuterium lamp itself.

In order to overcome the problems mentioned above, it is an object of the present invention to provide a gas discharge tube which attains smaller dimensions and easier assembling at the same time.

In the process of carrying out experiments for making the gas discharge tube smaller, the inventors have prepared prototypes which are made of a metal all but the light projection window of the side tube. As a result, it has been found that only about several tens of degrees of heat apply to the anode and cathode sections at the time of joining the side tube and the stem to each other, so that there are no thermal damages to the anode and cathode sections even in a structure in which the side tube is made so small that the cathode and anode sections are disposed closer to the side tube. The present invention is achieved according to this finding.

Namely, in order to overcome the above-mentioned problems, the gas discharge tube of the present invention is a gas discharge tube having a sealed envelope at least a part of which transmits light. The sealed envelope is filled with a gas and is provided with anode and cathode sections disposed therein. The electric discharge is generated between the anode and cathode sections, so that the light-transmitting part of the sealed envelope emits predetermined light outside. The gas discharge tube comprising a focusing electrode plate disposed between the anode and cathode sections and provided with an opening for focusing an electron directed from the cathode section to the anode section. The cathode section is disposed so as to be spaced from a line connecting the anode section and the opening of the focusing electrode plate to each other. The sealed envelope comprises a stem for securing the anode and cathode sections within the sealed envelope by way of respective stem pins independent from each other, at least respective securing portions of the stem pins being an insulator, an outer peripheral part of the stem being made of a metal, a side tube, made of metal, surrounding the anode and cathode sections and being joined to the outer peripheral part of the stem by welding, and a light projection window made of glass and secured to the side tube on the line connecting the anode section and the opening of the focusing electrode plate to each other.

According to the present invention, the side tube is made of a metal, at least the outer periphery of the stem is made of a metal, and they are joined to each other by welding. As a consequence, the discharge tube itself attains smaller dimensions while the assembling thereof is made easier by welding. Also, since the side tube has small dimensions and is made of a metal, its handling property improves extremely. Since the side tube is formed from a metal, the gas discharge tube is encouraged to have a wider range of processed forms, and is prospective for mass production.

The stem may be constructed by attaching a metal-made junction to the periphery of a glass-made body, or constructed by a metal-made body while a glass-made insulating portion is provided between the body and the stem pins.

Preferably, each of joint portions of the outer peripheral part of the stem and the side tube has a flange portion being secured to each other by welding. Such a configuration remarkably improves the easiness in assembling the side tube and the stem to each other. Also, such a flange portion can be provided with a positioning portion for arranging the gas discharge tube, so as to be utilized as a reference position with respect to the light-emitting part of the gas discharge tube.

Preferably, a wall face of the side tube is coated with a glass material or ceramic material. When the side tube is made of a metal, then some gases filling the sealed envelope may be transmitted through or occluded in the side tube. In this case, the gas pressure within the sealed envelope decreases with time, thereby yielding a fear of shortening the life as a gas discharge lamp. If the wall face of the side tube is coated with a glass material or ceramic material, then the reaction and occlusion between the side tube and gases can be prevented from occurring, whereby the degree of freedom in selecting the material and thickness of the side tube increases.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

BRIEF DESCRIPTION OF THE DRAWINGS

FIG. 1 is a sectional view showing a first embodiment of the gas discharge tube in accordance with the present invention, whereas

FIG. 4 is a sectional view showing a third embodiment of the gas discharge tube in accordance with the present invention, whereas

DETAILED DESCRIPTION OF PREFERRED EMBODIMENTS

Figure 1:
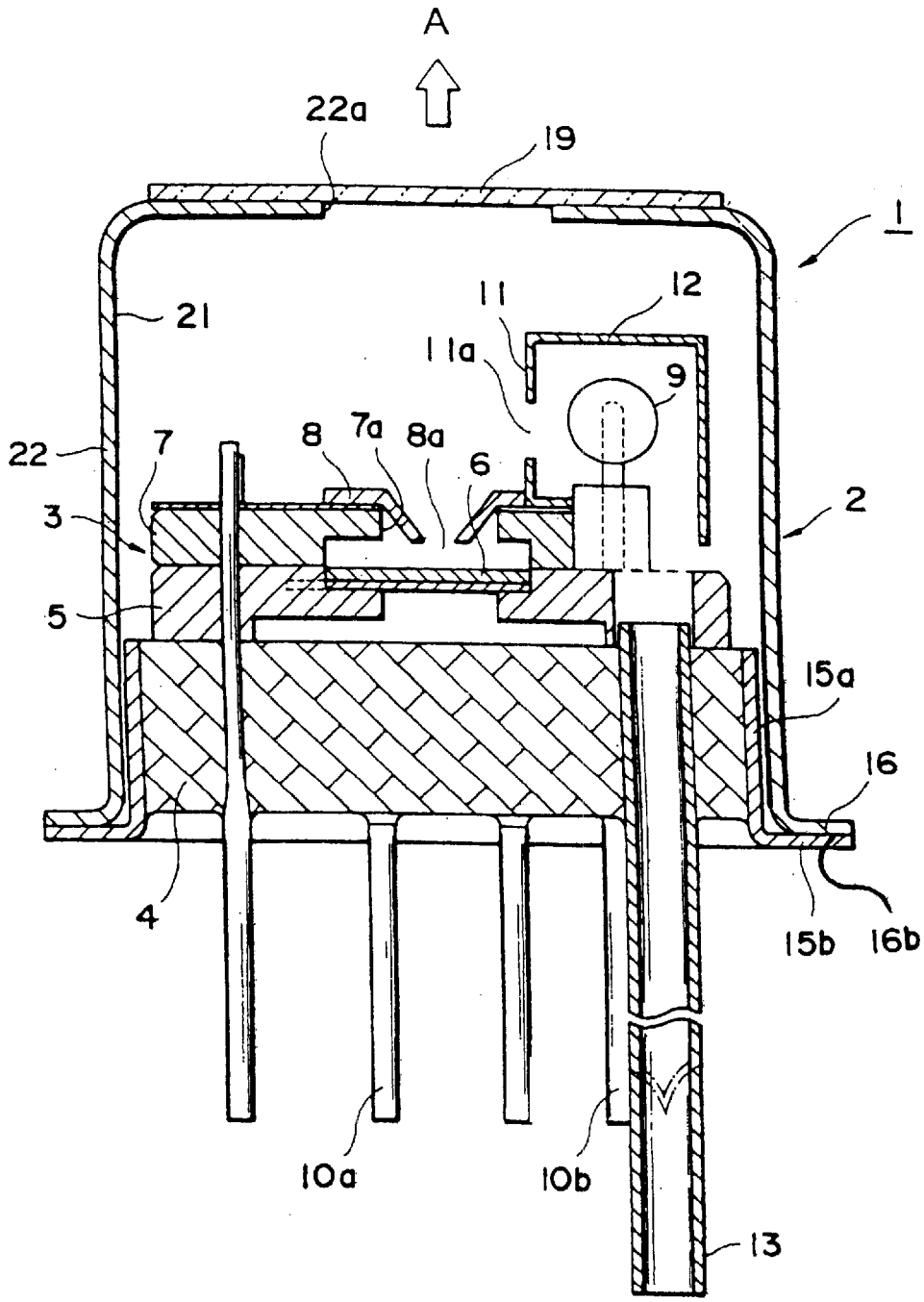

In the following, preferred embodiments of the gas discharge tube in accordance with the present invention will be explained in detail with reference to the accompanying drawings. To facilitate the comprehension of the explanation, the same reference numerals denote the same parts, where possible, throughout the drawings, and a repeated explanation will be omitted.

FIG. 1 is a sectional view showing a first embodiment of the gas discharge tube in accordance with the present invention. The gas discharge tube 1 shown in this drawing is a head-on type deuterium lamp and has a sealed envelope 2 filled with about several Torr of deuterium gas, whereas a light-emitting part assembly 3 is contained in the sealed envelope 2. The light-emitting part assembly 3 has an anode support plate 5 which is made of ceramics and disposed on a stem 4. An anode plate 6 is disposed on the anode support plate 5, so as to be spaced from the stem 4. The anode plate 6 is welded and secured to the upper end of a stem pin 10*a* which is fixed so as to penetrate through the stem 4. A spacer 7 made of ceramics is disposed on the anode support plate 5, a focusing electrode plate 8 is disposed on the spacer 7, and a focusing opening 8a formed in the focusing electrode plate 8 is disposed so as to face into an opening 7*a* of the spacer 7, while making the focusing electrode plate 8 are opposed the anode plate 6.

Beside the focusing opening 8*a*, a cathode section 9 is disposed on the upperside from the spacer 7. The cathode section 9 is welded and secured to the upper end of a stem pin 10*b* fixed so as to penetrate through the stem 4, and generates thermions upon electric discharge. Between the cathode, section 9 and the focusing opening 8*a*, a discharge rectifying plate 11 is disposed at a position deviated from an optical path (in the direction directly upward from the focusing opening 8*a* in the drawing). The discharge rectifying plate 11 is provided with an electron releasing window 11*a* formed as a rectangular opening for transmitting thermions therethrough. Also, the discharge rectifying plate 11 is welded and secured to the upper face of the focusing electrode plate 8, and is provided with a cover plate 12 having an L-shaped cross section so as to surround the upper side of the cathode section 9 and the rear side thereof opposite from the electron releasing window 11*a*. The cover plate 12 keeps the sputtering materials or evaporated materials released from the cathode section 9 from attaching to a light projection window 19 made of silica glass or UV-transmitting glass.

While thus configured light-emitting part assembly 3 is disposed within the sealed envelope 2, an exhaust pipe 13 is secured to the stem 4 since it is necessary for the sealed envelope 2 to be filled with several Torr of deuterium gas. Utilizing this exhaust pipe 13, the sealed envelope 2 can be appropriately filled with a predetermined pressure of deuterium gas after the air is once evacuated therefrom. After the filling, the exhaust pipe 13 is closed, whereby the sealed envelope 2 is sealed off.

Here, the sealed envelope 2 has a side tube 22 made of a Kovar metal, stainless steel, or the like, which is formed like a cylinder whose both sides are open, whereas the glass-made projection window 19 is secured to an outer wall face 22*b* of the side tube body 22 so as to close a circular opening portion 22*a* formed at the top part of the side tube 22. The stem 4 is formed like a cylindrical column from glass (e.g., Kovar glass), whereas its peripheral part is provided with a joint member 15 made of a metal (e.g., Kovar metal). The joint member 15 comprises a cylindrical body portion 15*a* to be secured to the outer wall face of the stem 4 by fusion or bonding, and a flange portion 15*b* radially extending like a brim from the lower end of the body portion 15*a*.

On the other hand, the other open end side of the side tube 22 is provided with a flange portion 16, made by integral molding of the side tube 22, radially extending like a brim from the lower end thereof. Hence, while the stem 4 is being inserted into the side tube 22 in a state where the light-emitting part assembly 3 is secured onto the stem 4, the metal flange portion 15*b* of the stem 4 and the metal flange portion 16*b* of the side tube 22 are brought into close contact with each other and, with this state being maintained, thus joined part is subjected to a welding operation such as electric welding, laser welding, or the like, so as to effect hermetic sealing of the sealed envelope 2. After this welding operation, the air in the sealed envelope 2 is evacuated through the exhaust pipe 13, the sealed envelope 2 is subsequently filled with about several Torr of deuterium gas, and the exhaust pipe 13 is closed thereafter, whereby the assembling operation is completed. Here, the first flange portion 15*b* is utilized as a reference position with respect to the light-emitting part of the gas discharge tube 1 (the part where arc balls are generated in front of the focusing opening 8*a*). Namely, when the positional relationship between the first flange portion 15*b* and the light-emitting part is kept constant upon assembling the discharge tube 1, the positioning of the light-emitting part becomes easier, whereby the assembling workability and positioning accuracy with respect to an apparatus for driving the gas discharge tube 1 (not shown) are expected to improve.

Figure 2:
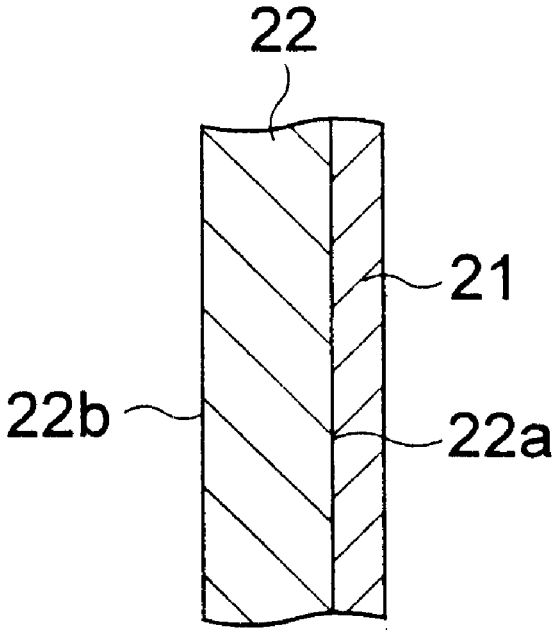
FIG. 2 is an enlarged view of the inner wall portion of its side tube.

Further, the inner wall face 22*a* of the side tube 22 is coated with a Kovar glass material 21 substantially over the whole surface thereof as shown in FIG. 2. For making such a side tube 22, the side tube 22 made of a metal is initially molded into a predetermined form by pressing. Thereafter, for inhibiting deuterium gas filling the sealed envelope 2 from inconveniently being transmitted through or occluded in the side tube 22, the inner wall face 22*a* of the side tube 22 is coated with the glass material 21 by painting or CVD. As a result, not only the life of the gas discharge tube 1 can be kept from shortening, but also the side tube 22 is encouraged to have a wider range of processed forms and securely attains a prospect for mass production since it is made of a metal which is easier to mold by pressing.

As the glass material 21, silica type glass and crystallized glass can also be employed. Since the crystallized glass is glass in which crystals are deposited, it can securely inhibit a phenomenon such as transmission, occlusion, or chemical reaction which may occur in the side tube 22. Examples of the crystallized glass include $MgF_2$ glass, sapphire glass, $SiO_2$ glass, $CaF_2$ glass, and the like. Similar effects are also obtained when ceramics materials such as alumina, silicon nitride, and the like are employed in place of the glass material 21.

In the case where impurities contained in the glass material 21 are let out into the sealed envelope 2 during the assembling or use of the gas discharge tube 1 and thereby adversely affect characteristics of the gas discharge tube 1, the glass material 21 may be disposed on the outer wall face 22*b* side of the side tube 22. Also, the glass material 21 may be disposed on both of the inner wall face 22*a* and outer wall face 22*b* as a matter of course.

Operations of thus configured gas discharge tube 1 will now be explained in brief. First, an electric power of about 10 W is supplied from an external power source to the cathode section 9 for about 20 seconds, so as to preheat the cathode section 9. Thereafter, a DC release voltage of about 150 V is applied across the cathode section 9 and the anode plate 6, so as to prepare for arc discharge.

In the state where the preparation is in order, a trigger voltage of about 350 V to 500 V is applied across the cathode section 9 and the anode plate 6. Here, while being rectified by the discharge rectifying plate 11, the thermions released from the cathode section 9 converge at the focusing opening 8*a* of the focusing electrode plate 8 and reach the anode plate 6. Then, arc discharge occurs in front of the focusing opening 8*a*, and ultraviolet rays taken out from the arc balls generated upon this arc discharge are transmitted through the light projection window 19 and released in the direction of arrow A, i.e., outside.

Figure 3:
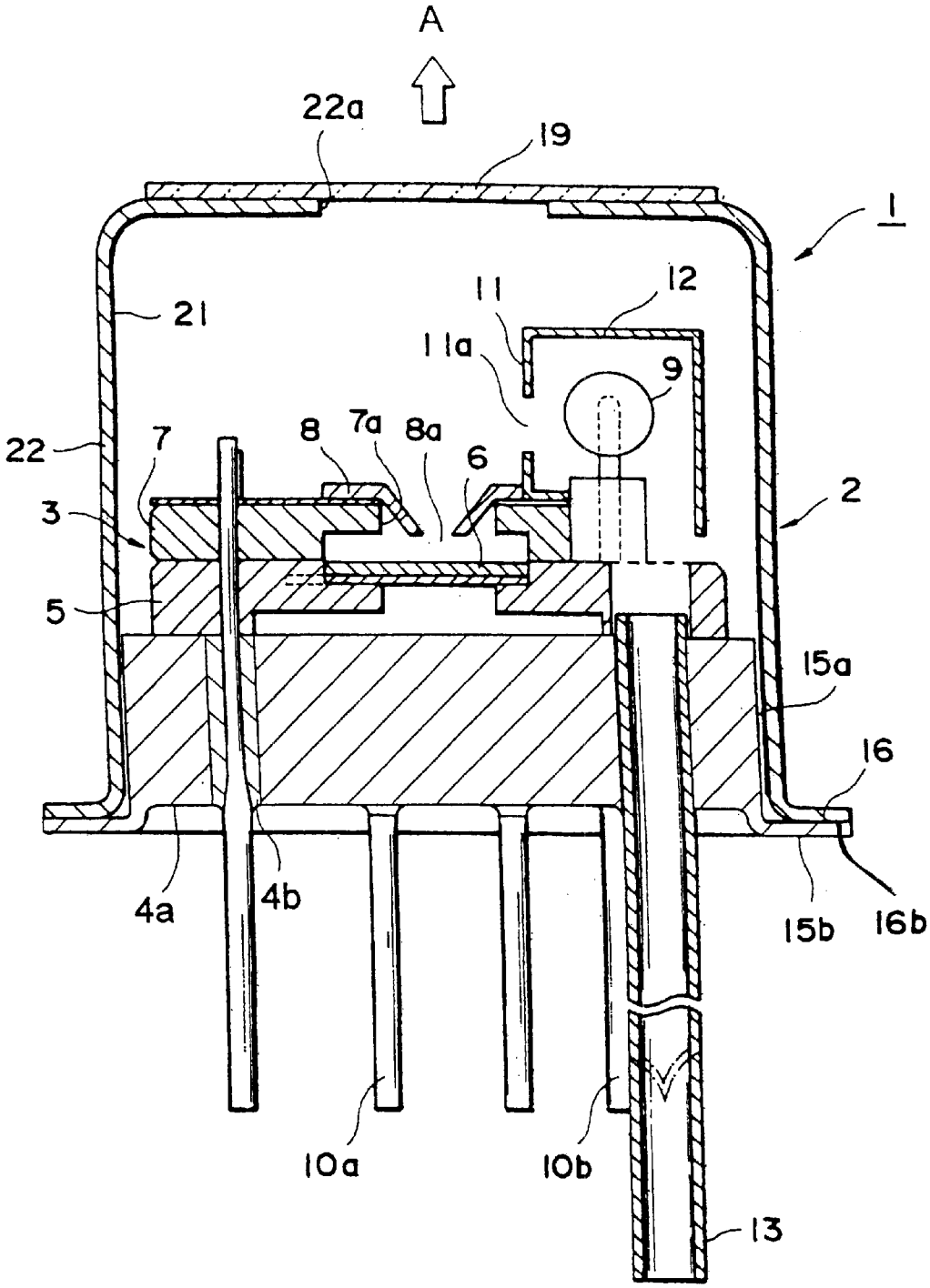
FIG. 3 is a sectional view showing a second embodiment of the gas discharge tube in accordance with the present invention.

FIG. 3 is a sectional view showing the gas discharge tube in accordance with a second embodiment of the present invention. The second embodiment differs from the first embodiment shown in FIG. 1 in the structure of the stem 4 portion. Namely, in this embodiment, the stem 4 portion is constituted by a metal-made body 4*a* integrated with the peripheral portion 15, whereas a part thereof surrounding a stem pin 10 is provided with an insulating portion 4*b* made of glass. Effects similar to those in the above-mentioned first embodiment can be obtained in the second embodiment as well.

Figure 4:
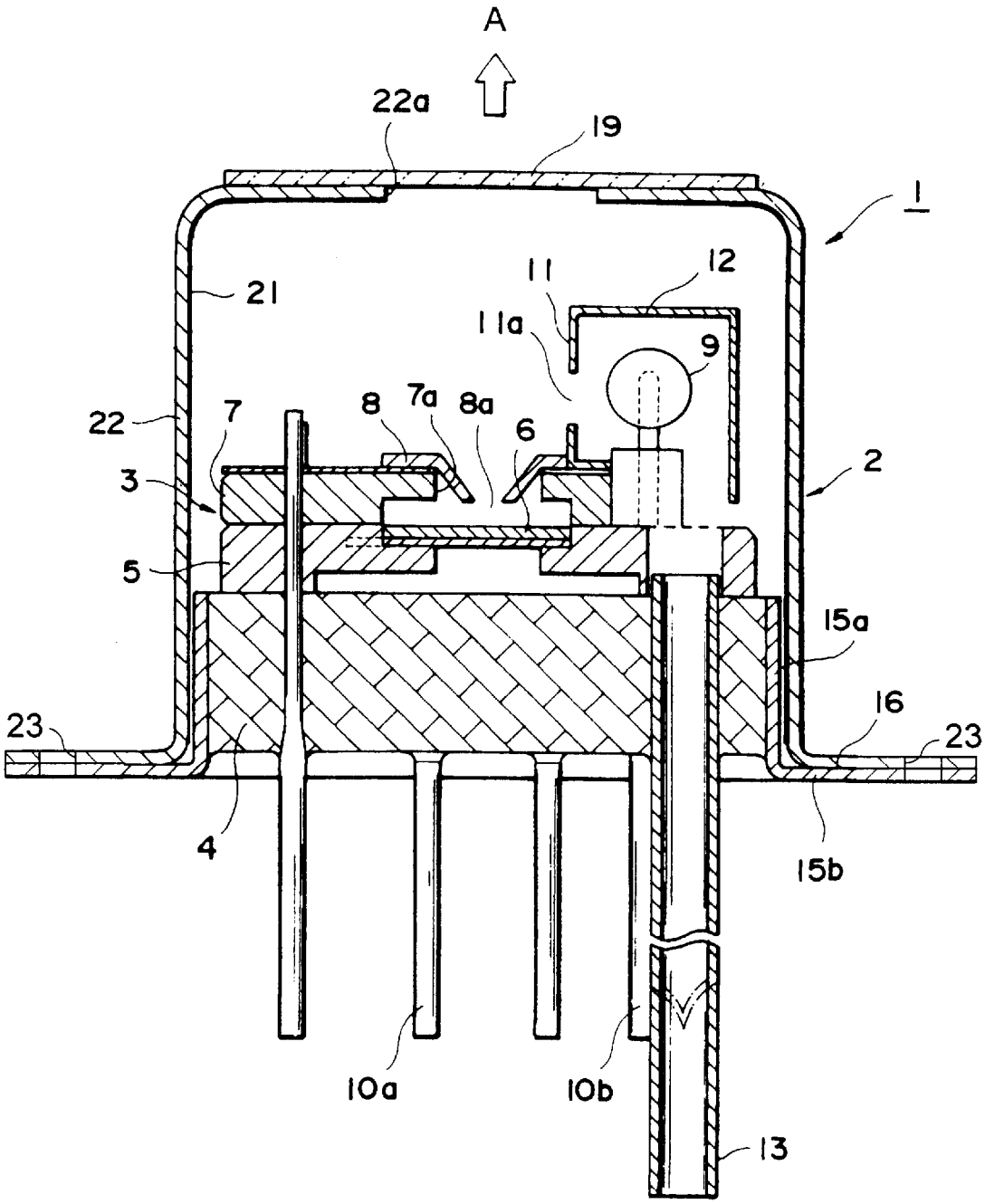
Figure 5:
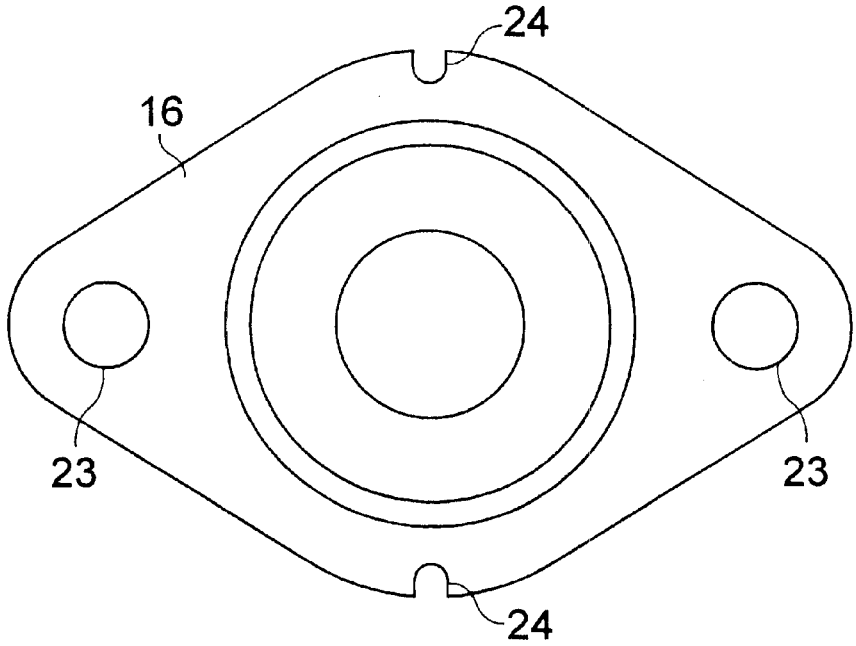
FIG. 5 is a plan view thereof.

FIG. 4 shows a sectional view of the gas discharge tube 1 in accordance with a third embodiment of the present invention, whereas FIG. 5 shows a plan view thereof. This embodiment differs from the first embodiment shown in FIG. 1 in that the flange portions 15*b*, 16*b* have greater diameters and are provided with holes 23 for passing attachment screws and the like and positioning cutouts 24. Such a configuration further facilitates the positioning of the light-emitting part, whereby the assembling workability and positioning accuracy with respect to an apparatus for driving the discharge tube (not depicted) are expected to further improve.

The present invention should not be restricted to the above-mentioned embodiments. For example, when joining the side tube 22 and the stem 4 by welding, the outer wall face of the body portion 15*a* and the inner wall face 22*a* at the lower end of the side tube 22 may be welded to each other without employing a flange configuration, whereby the flange portions can be eliminated, which further contributes to attaining smaller dimensions. Also, there may be a case where the whole stem 4 is constituted by a metal (e.g., Kovar metal) while the outer periphery of the stem 4 is provided with a first joint member 15*b* made of a metal.

The gas discharge tube of the present invention may be filled with not only deuterium gas but also other gases.

Since the gas discharge tube in accordance with the present invention is configured as mentioned above, it can simplify its assembling while being made likely to have smaller dimensions.

The gas discharge tube in accordance with the present invention is applicable not only to deuterium lamps, but also to various gas discharge tubes; and is favorably usable as a gas discharge tube utilized as a light source for a spectroscope, chromatography, or the like in particular.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A gas discharge tube having a sealed envelope at least a part of which transmits light, said sealed envelope being filled with a gas and being provided with anode and cathode sections disposed therein, electric discharge being generated between said anode and cathode sections, so that the light-transmitting part of said sealed envelope emits predetermined light outside, said gas discharge tube comprising a focusing electrode plate disposed between said anode and cathode sections and provided with an opening for focusing an electron directed from said cathode section to said anode section, said cathode section being disposed so as to be distanced from a line connecting said anode section and said opening of said focusing electrode plate to each other;

said sealed envelope comprising:

a stem for securing said anode and cathode sections within said sealed envelope by way of respective stem pins independent from each other, at least respective securing portions of said stem pins being an insulator, an outer peripheral part of said stem being made of a metal;

a side tube, made of metal, surrounding said anode and cathode sections and being joined to the outer peripheral part of said stem by welding, and having an inner wall surface coated with a glass material or ceramics material; and a light projection window made of glass and secured to said side tube on the line connecting said anode section and said opening of said focusing electrode plate to each other.

2. A gas discharge tube according to claim 1, wherein each of the outer peripheral part of said stem and a joint portion of said side tube has a flange portion being joined to each other by welding.

3. A gas discharge tube according to claim 2, wherein said flange portions are provided with a positioning portion for arranging said gas discharge tube.

4. A gas discharge tube according to claim 1, wherein said stem is constituted by attaching a metal-made joint portion to a periphery of a glass-made body.

5. A gas discharge tube according to claim 1, wherein said stem comprises a metal-made body, a glass-made insulating portion being disposed between each stem pin to be fixed and the body.

* * * * *